United States Patent [19]

Binhack et al.

[11] Patent Number: 5,036,691

[45] Date of Patent: Aug. 6, 1991

[54] SWAGING MACHINE COMPRISING A DIE CHANGING MECHANISM

[75] Inventors: Fritz Binhack, Bretten-Ruit; Frank Grau, Pforzheim, both of Fed. Rep. of Germany

[73] Assignee: Felss GmbH & Co. KG, Konigsbach-Stein, Fed. Rep. of Germany

[21] Appl. No.: 544,110

[22] Filed: Jun. 26, 1990

[30] Foreign Application Priority Data

Aug. 1, 1989 [DE] Fed. Rep. of Germany ..... 3925452

[51] Int. Cl.[5] ..... B21J 13/08

[52] U.S. Cl. ..... 72/76

[58] Field of Search ..... 72/76, 402

[56] References Cited

U.S. PATENT DOCUMENTS 1,507,621 9/1924 Perry et al. ..... 72/76

4,250,607 2/1981 Lillbacka et al. ..... 72/402

*Primary Examiner*—Lowell A. Larson

*Attorney, Agent, or Firm*—Dvorak and Traub

[57] ABSTRACT

A swaging machine for swaging a workpiece as it is axially fed or for recessing a workpiece when it is axially fixed and which comprises two or more dies and two or more stems for actuating said dies, die guiding means for guiding said dies, a front cover for covering said dies, and wedges extending between said stems and dies to vary the radial spacing of said dies and stems. The machine is provided with a die changing mechanism comprising a pivotally movable or displaceable die handling member, which is formed with juxtaposed chamber, which contain respective gripping means for gripping respective sets of dies, and said die handling member is pivotally movable or displaceable to a plurality of positions in which respective ones of said chambers are centered on a predetermined workpiece feeding axis. Said die handling member comprises a cam slot, which is engaged by the front cover and the front cover is pivotally movable or displaceable, like the die handling member, and is thus movable between an operating position, in which said front cover covers said dies, and a die changing position, in which said dies are exposed.

20 Claims, 4 Drawing Sheets

SWAGING MACHINE COMPRISING A DIE CHANGING MECHANISM

BACKGROUND OF THE INVENTION

1. Field of the Invention

This invention relates to a swaging machine for swaging a workpiece as it is axially fed or for recessing an axially fixed workpiece, which machine comprises two or more swaging tools consisting each of a stem and a die associated with said stem, die guiding means for guiding said dies and a front cover for covering said dies in said die guiding means and optionally comprises slidable wedges extending between each of said stems and one of said dies.

2. Description of the Prior Art

Known swaging machines for swaging a workpiece as it is axially fed or for recessing an axially fixed workpiece comprise two or more swaging tools consisting each of a stem and a die associated with said stem, die guiding means for guiding said dies and a front cover for covering said dies in said die guiding means and optionally comprise slidable wedges extending between each of said stems and one of said dies. In the known machines of that kind the dies are changed by hand in a complicated and time-consuming operation, which reduces the economy of the work, particularly if the workpieces are to be swaged in small lots so that the dies must often be changed, or when workpieces are to be formed with a plurality of steps.

SUMMARY OF THE INVENTION

It is an object of the invention to provide a swaging machine which is of the kind described first hereinbefore with a die changing mechanism which permits dies to be changed by a non-manual operation.

In accordance with the invention that object is accomplished in that a machine which is of the kind described first hereinbefore is provided with a die changing mechanism comprising a pivotally movable or displaceable die handling member, which is formed with juxtaposed chambers, which contain respective gripping means for gripping respective sets of dies, and said die handling member is pivotally movable or displaceable to a plurality of positions in which respective ones of said chambers are centered on a predetermined workpiece feeding axis. Said die handling member comprises a cam slot, which is engaged by the front cover and the front cover is pivotally movable or displaceable, like the die handling member, and is thus movable between an operating position, in which said front cover covers said dies, and a die changing position, in which said dies are exposed.

In association with the gripping means in the chambers of the die handling member, operating levers are provided, which are pivoted on axes extending at right angles to the workpiece feeding axis and when one of said chambers is centered on said workpiece feeding axis the associated operating lever is operable to move one of said sets of dies from said tool guiding means of the machine into said one chamber or to move said set of dies from said one chamber into said tool guiding means.

DETAILED DESCRIPTION OF THE PREFERRED EMBODIMENT

Figure 1:
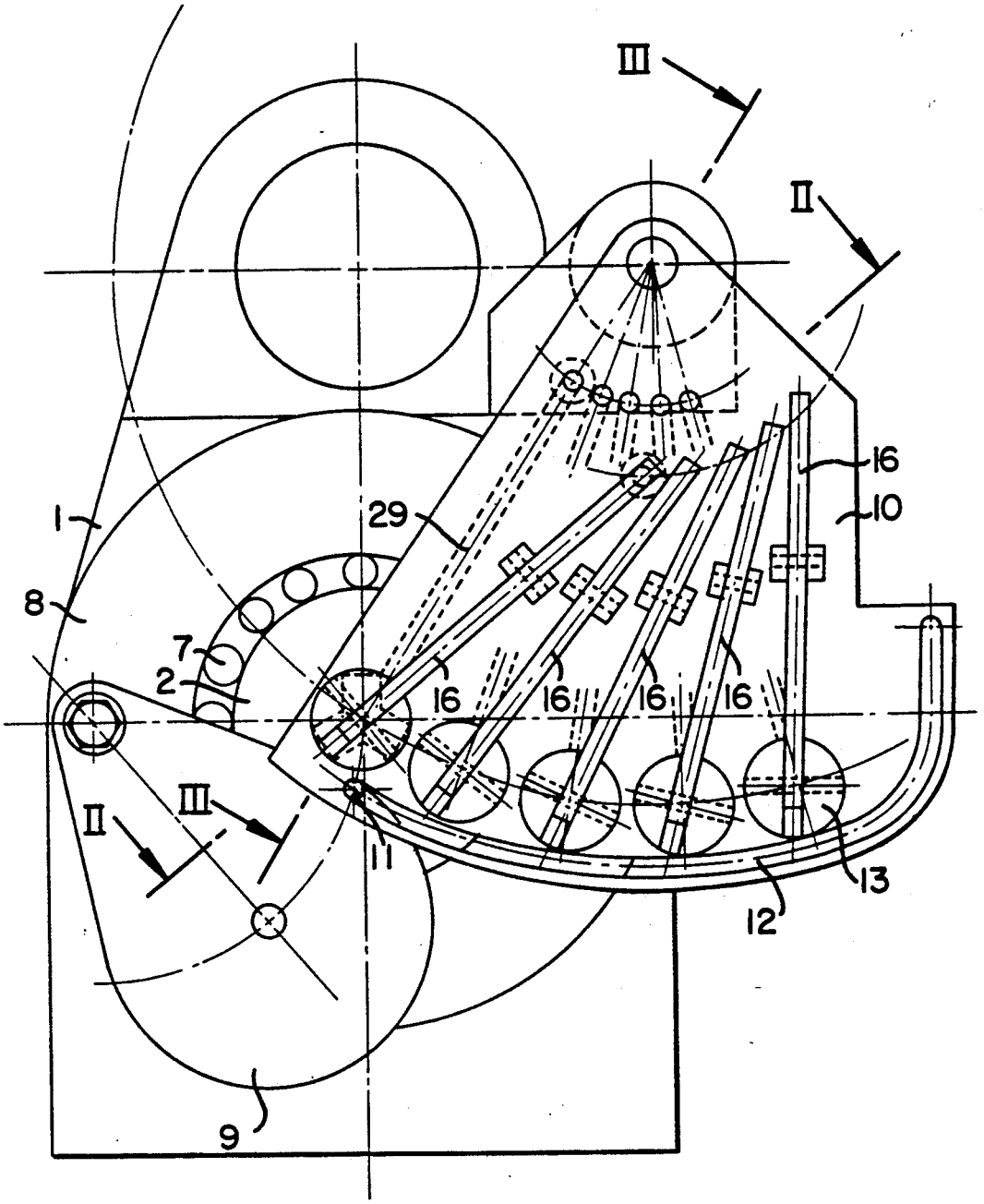
FIG. 1 is a front elevation showing a swaging machine provided with a die changing mechanism.
Figure 2:
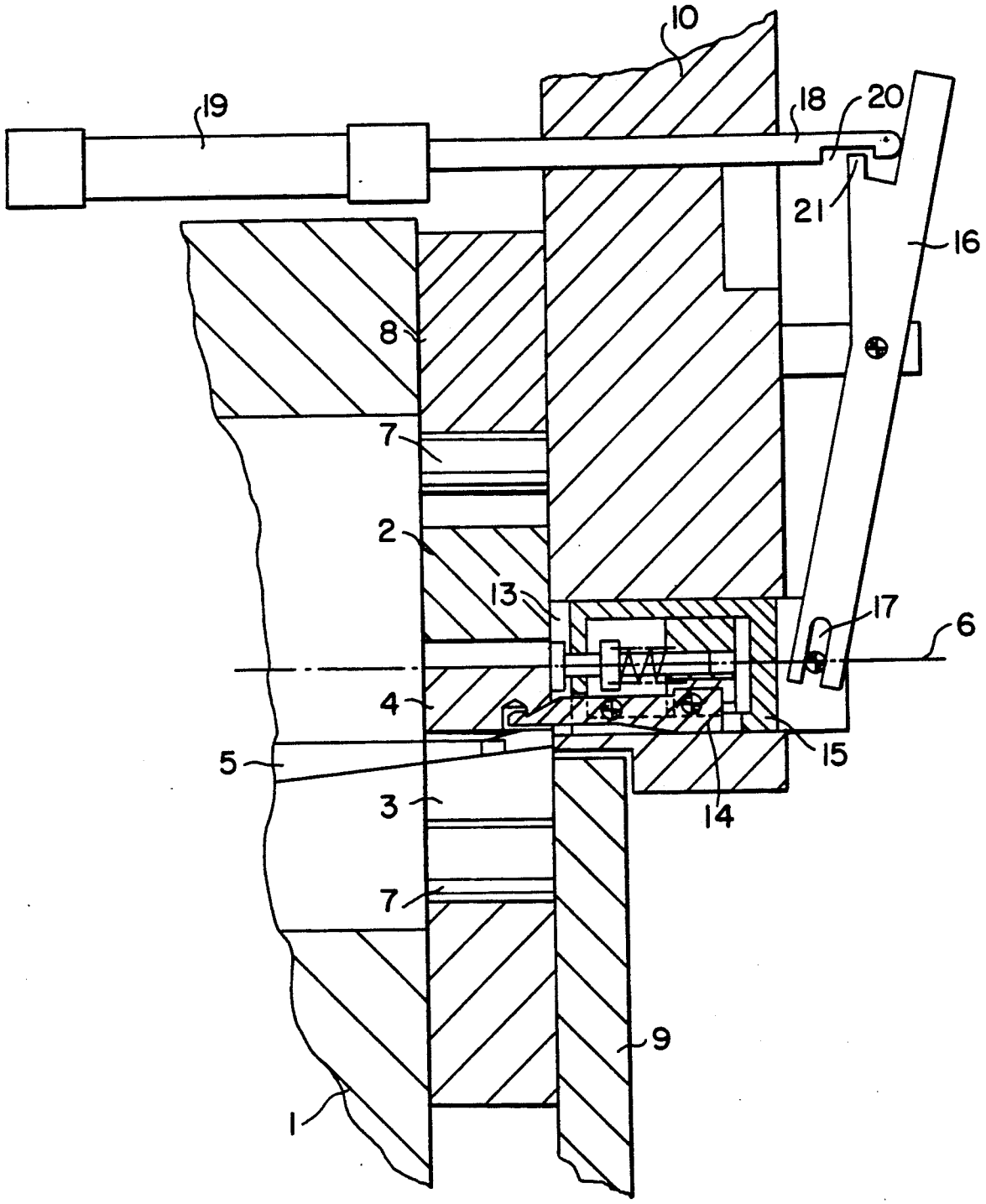
FIG. 2 is a transverse sectional view taken on line II—II in FIG. 1.
Figure 3:
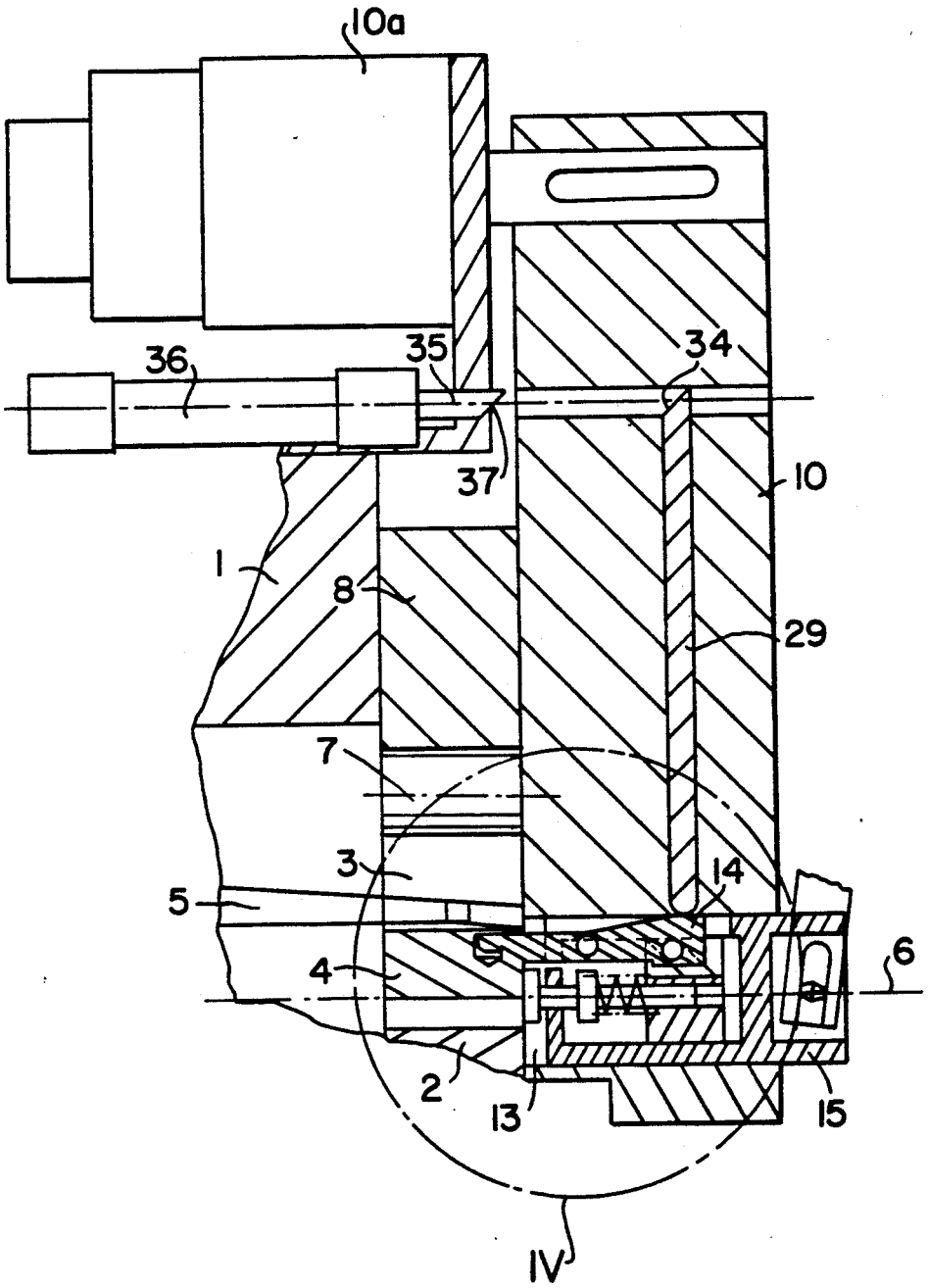
FIG. 3 is a transverse sectional view taken on line III—III in FIG. 1.
Figure 4:
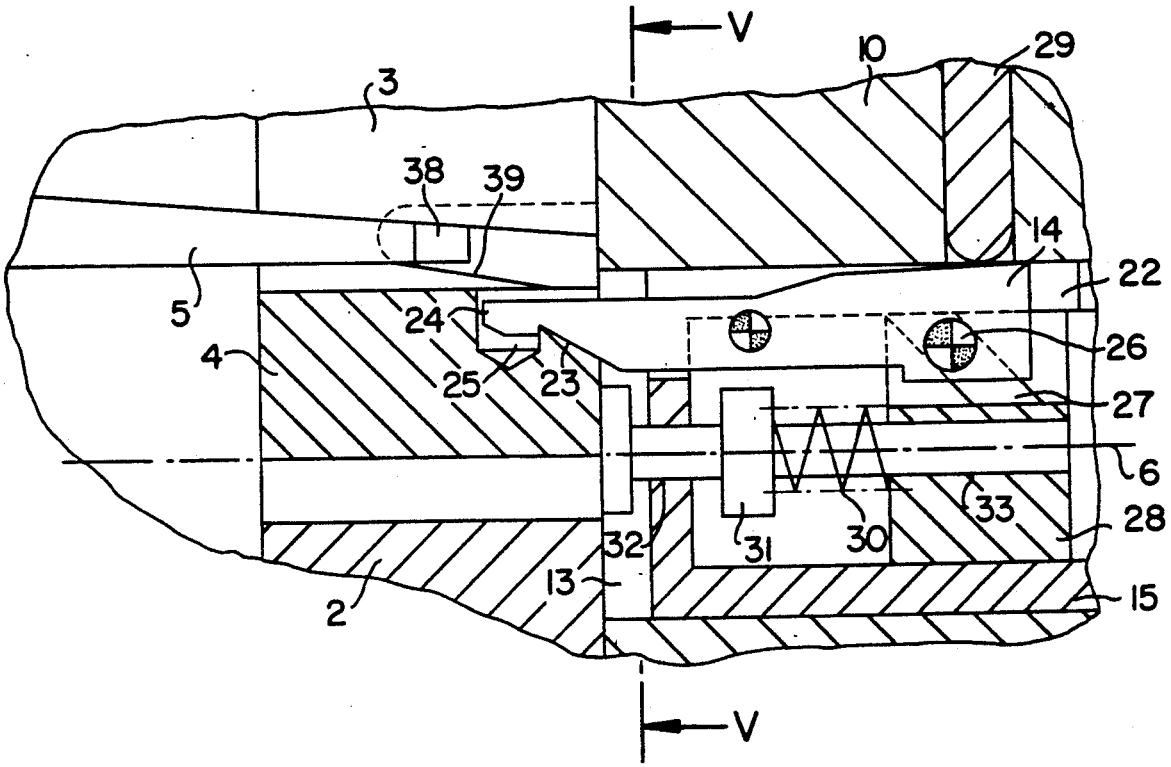
FIG. 4 shows on a larger scale the portion designated IV in FIG. 3.

Further details of a swaging machine which is provided with a die changing mechanism will now be described more in detail with reference to a preferred embodiment shown in the drawing.

Figure 5:
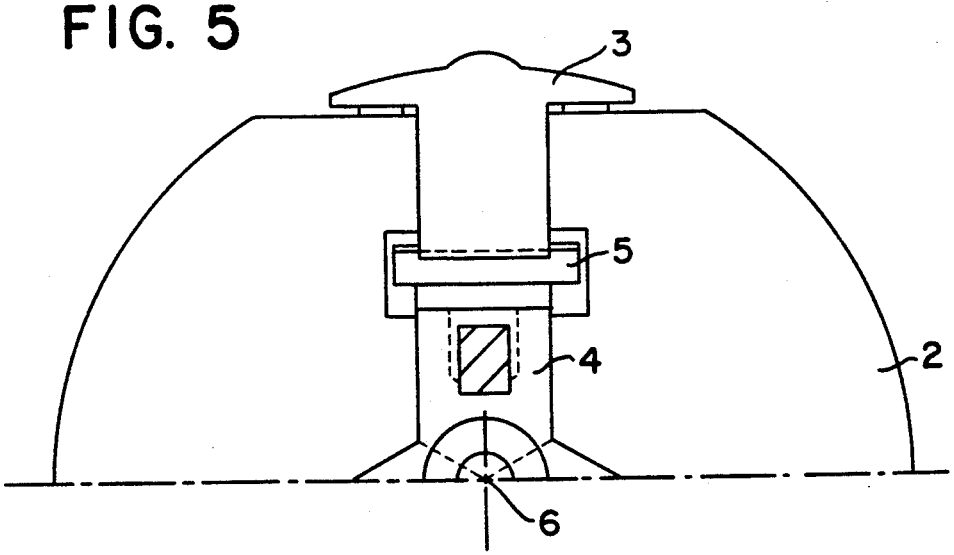
FIG. 5 is an elevation on line V—V in FIG. 4.

From the drawing, particularly from FIGS. 1 and 5, it is apparent that the swaging machine comprises a tool housing 1, in which a tool guiding member 2 is mounted, in which swaging tools consisting each of a stem 3, a die 4 and an interposed wedge 5, which is slidable to vary the radial length of each tool, are radially slidably mounted. Three of such swaging tools are provided in the illustrated embodiment. A predetermined workpiece feeding axis on which a workpiece is adapted to be fed into the housing 1 is designated 6. Pressure-applying rollers 7 are rotatably mounted in a mounting ring 8 and during a rotation of the tools about the axis 6 will consecutively engage the stems 3 so that the latter together with the dies 4 and the interposed wedges 5 will move radially inwardly to act on the workpiece which has been or is being fed on the axis 6. The design and mode of operation of such a machine are described in detail in German Patent Specification No. 32 05 584.

On the front side of the tool housing 1 containing the tools 3, 4, 5, a pivotally movable or displaceable front cover 9 and a pivotally movable or displaceable die handling member 10 are movably mounted. In the illustrated embodiment the die handling member 10 is pivotally movable by means of a rotary motor 10*a*. The pivoted front cover 9 and the pivoted die handling member 10 are coupled by means of a pin 11, which is mounted on the front cover 9 and protrudes into a cam slot 12 formed in the die handling member 10 so that the pivotal movement of the latter will result in a pivotal movement of the front cover 9. The front cover 9 is adapted to assume an operating position to cover the dies in the tool housing 1 and a die changing position, in which the front cover 9 exposes said dies in the housing 1. The cam slot 12 extends along the bottom edge of the die handling member 10, which adjacent to said cam slot 12 is formed with a plurality of juxtaposed chambers 13, which are spaced apart along the cam slot 12. Each chamber 13 contains a toolholder housing 15, which in turn contains gripping means consisting of three rockers 14. An operating lever 16 is associated with each toolholder housing 15. When a selected one of the chambers 13 has been centered on the axis 6, the toolholder housing 15 slidably mounted in said chamber 13 is movable by the associated operating lever 16 to move a set of dies 3 which are centered on the axis 6 along said axis 6 toward and away from the die guiding member 2. Each operating lever 16 is coupled to the associated toolholder housing 15 by means of a pin-slot coupling 17. A piston-cylinder device 19 is associated with each operating lever 16 and comprises a piston rod 18, which has a hook-shaped end portion 21 that extends into a recess 20 defined by a hook-shaped portion of the operating lever 16 so that the piston-cylinder device 19 is operable to impart a pivotal movement to the operating lever 16.

Each toolholder housing 15 is formed in its shell with three axial slots 22, in which respective rockers 14 are pivotally mounted. Each rocker 14 has an end portion which protrudes from the toolholder housing 15 toward the die guiding member 2 and which is formed with a beveled surface 23 for engaging a mating surface of one of the dies 4 and has at its free end a nose 24 for extending into a blind bore 25 formed in said die 4. At that end which is opposite to the die guiding member 2 each rocker 14 is provided with a protruding pin 26, which extends into an oblique slot 27, which is formed on the outside peripheral surface of a camming ring 28, which is axially slidably mounted in the toolholder housing 15.

The tool handling member 10 is formed with a plurality of bores, which open into respective ones of the chambers 13. In each of said bores, a push rod 29 is slidably mounted which is engageable with one of the rockers 14 at that arm that is remote from the die guiding member 2. The push rod 29 is axially movable to lift the nose 24 out of the blind bore 25 so that said one rocker 14 is no longer locked to the die 4. Each toolholder housing 15 also contains an axially slidably mounted backing member 31, which is biased toward the die guiding member 2 by a spring 30 and which is guided near one end at 32 in the toolholder housing 15 and at its other end at 33 in the camming ring 28. At its end that is remote from the toolholder housing 15, each push rod 29 has a beveled end face 34, which is engageable by a mating end face 37 of a piston rod 35, which extends at right angles to the push rod 29 and belongs to a piston-cylinder device 36 and is operable to push the push rod 29 towards the toolholder housing 15.

Sliding wedges 5 are interposed between each stem 3 and the associated die 4 and will be provided particularly when the swaging machine is used to recess a workpiece which is held in a fixed axial position. Such wedges may be used to vary the radial spacing of the stems 3 and dies 4 and to relieve the dies 4 when they are to be exchanged. Otherwise the dies 4 may be exchanged when the stems 3 are disengaged from the rollers 7. As is apparent from German Patent Specification 32 05 584, the wedges 5 are movably suspended in associated receptacles and in the present case are provided with lateral projections 38, each of which is slidably supported on an oblique slideway 39 formed in the die guiding member 2 so that the wedges will not fall to the center of the tool housing 1 as the dies 4 are moved out of and into the die guiding member 2. If the wedges 5 were permitted to fall to the center of the tool housing 1, they would obstruct the insertion of the new dies 4 in case of a change.

In the illustrated machine, the die guiding member 2 is adapted to engage a set of swaging dies 4 so that they are equiangularly spaced around and radially movable relative to the workpiece feeding axis 6 and for radially guiding said dies 4 relative to said axis 6. The rollers 7 and the stems 3 constitute die actuating means for radially moving the dies 4 engaged by the die guiding means 2 toward the workpiece feeding axis 6 in unison. The front cover 9 is disposed on one side of the die guiding means 2 and is mounted to be movable relative to the die guiding member 2 transversely to the axis 6 between a first position, in which the front cover 9 covers the dies 4 engaged by the die guiding member 2, and a second position for exposing said dies 4. The die handling member 10 is disposed on the same axial side of the die guiding member 2 as the front cover 9 and is mounted to be movable relative to the die guiding member 2 transversely to the axis 6 to inner and outer end positions and at least one intermediate position and is coupled to said front cover 9 for a movement of said front cover 9 to its said first and second positions as the die handling member 10 is moved to its said outer and inner end positions, respectively.

The juxtaposed chambers 13 in the die handling member 10 are parallel to the axis 6 and spaced apart transversely to the axis 6. Each chamber 13 is arranged to be centered on the axis 6 in one of said inner and intermediate positions of the die handling member 10. A toolholder is slidably mounted in each chamber 13 for a movement along the axis 6 and is operable to extend into and to be retracted from the die guiding member 2 when said chamber 13 is centered on the axis 6. Each of said toolholders comprises die gripping means for releasably locking a set of said dies 4 in a position in which said dies 4 are equiangularly spaced around the axis 6 when the associated chamber 13 is centered on the axis 6 and the toolholder is being extended into and retracted from the die guiding member 2 to move the dies of said set along the axis 6 into and out of engagement with the die guiding member 2. The stems 3 of the die actuating means are equiangularly spaced around the axis 6. A wedge 5 extends between each stem 3 and one of the dies 4 and is movable along the axis 6 to vary the radial spacing of said stem and die. The front cover 9 and the die handling member 10 are pivoted on respective pivotal axes, which are parallel to the workpiece feeding axis 6.

Each toolholder comprises a toolholder housing 15 and a plurality of equiangularly spaced apart rockers 14, which constitute said gripping means and are pivoted in said housing 15 on respective pivotal axes, which are transverse to the workpiece feeding axis 6. The rockers 14 are pivotally movable about said pivotal axes to lock and release respective dies 4 of one of said sets and are spring-biased to a locking position.

The pin 11 protruding from the front cover 9 constitutes a cam follower, which engages the cam slot 12 to couple the front cover 9 and the die handling member 10 for moving in unison transversely to the axis 12.

A plurality of operating levers 16 are pivoted to the die handling member 10 on respective pivotal axes, which are at right angles to the workpiece feeding axis. Each operating lever 16 is pivotally operable to extend the associated toolholder into and to retract it from the die guiding member 2 when the chamber 13 containing said toolholder is centered on the workpiece feeding axis 6. Each of the operating levers 16 comprises a first arm, which is coupled to a toolholder housing 15, and a second arm, which is formed with the recess 22.

Each toolholder housing 15 is formed on its outside peripheral surface with a plurality of slots 22, which are equiangularly spaced apart and extend along the workpiece feeding axis 6. Each rocker 14 is pivoted in the toolholder housing 15 in one of the slots 22 and has an end portion which protrudes from the toolholder housing 15 and is formed with a radially inwardly facing beveled surface 23 and with a radially inwardly directed projection 24. Each die 3 is formed with a beveled surface for mating engagement with the beveled surface 23 and with a recess 25 for receiving the projection 24 to lock the die 3 to the rocker 14.

A camming ring 28 is slidably mounted in each toolholder housing 15 for a movement along the axis 6 and is formed in its outside peripheral surface with a plurality of equiangularly spaced apart slots 27, which extend radially inwardly and axially outwardly with respect to the die guiding member 2. Each rocker 14 comprises a first arm protruding from the toolholder housing 15 toward said die guiding means 2 and a second arm, which is formed with the cam follower pin 26 extending into one of the slots 27. A push rod 29 is associated with each of the chambers 13 and is longitudinally slidably mounted in the die handling member 10 and is operable to engage one of the rockers 14 of the associated toolholder so as to move said one rocker 14 out of said locking position and to force said cam follower pin 26 of said one rocker 14 further into the associated slot 27 to impart to the camming ring 28 an axial movement which owing to the cooperation of the other slots 27 and the other cam followers 26 causes also the other rockers 14 of the toolholder to move out of the locking position. An axially extending backing member 31 is centrally disposed in each toolholder housing 15 and has an end portion which is axially slidably mounted in the camming ring 28 and another end portion which is axially slidably mounted in the toolholder housing 15 and protrudes from the housing 15 toward the die guiding member 2 and is axially engageable with the equiangularly spaced apart dies 3 of one of said sets.

Each push rod 29 has in said die handling member 10 a beveled end face 34 opposite to the associated rocker 14. Piston rod means 35 extend at right angles to each push rod 29 and have a beveled end face 37 for mating engagement with the beveled end face 34 of each push rod 29 and are axially operable to move each push rod 29 into engagement with the associated rocker 14 of one of said toolholders when the associated chamber 13 is centered on the axis 6. The piston rod means comprise a piston rod 35, which is retractable out of the die handling member 10 to permit said die handling member 10 to move to each of said inner and outer and intermediate positions and is extensible into said die handling member 10 for a mating engagement of said beveled end face 37 of said piston rod 35 with the beveled end face 34 of each push rod 29.

The wedges 5 are retractable from said stems 3 and dies 4 engaged by the die guiding member 2 in order to release the dies 4 for an exchange. Each of the wedges 5 has a small end adapted to extend between one of the stems 3 and one of the dies 4 engaged by the die guiding member 2 and is provided at said small end with lateral projections 38. The die guiding means are formed with an oblique slideway 39 for slidably supporting said projections 38 in order to restrain said wedges 5 against falling toward the axis 6 as one of the toolholders moves said dies 4 of one of said sets out of and into engagement with the die guiding member 2.

We claim:

1. In a swaging machine defining a workpiece feeding axis and comprising die guiding means for engaging a set of swaging dies so that they are equiangularly spaced around and radially movable relative to said axis and for radially guiding said dies relative to said axis, die actuating means for radially moving said dies engaged by said tool guiding means toward said axis in unison to swage a workpiece which is centered on said axis, and a front cover disposed on one axial side of said tool guiding means and adapted to cover said dies engaged by said die guiding means, the improvement residing in that said front cover is mounted to be movable relative to said die guiding means transversely to said axis between a first position, in which said front cover covers said dies engaged by said die guiding means, and a second position for exposing said dies engaged by said die guiding means, and said machine is provided with a die changing mechanism, which comprises a die handling member, which is disposed on the same axial side of said die guiding means as said front cover and is mounted to be movable relative to said die guiding means transversely to said axis to inner and outer end positions and at least one intermediate position and is coupled to said front cover for a movement of said front cover to its said first and second positions as said die handling member is moved to its said outer and inner end positions, respectively, said die handling member is formed with a plurality of juxtaposed chambers, which are parallel to said axis and spaced apart transversely to said axis, each of said chambers is arranged to be centered on said axis in one of said inner and intermediate positions of said die handling member, a toolholder is slidably mounted in each of said chambers for a movement along said axis and is operable to be extended into and retracted from said die guiding means when said chamber is centered on said axis, and each of said toolholders comprises die gripping means for releasably locking a set of said dies in a position in which said dies of said set are equiangularly spaced around said axis when the associated chamber is centered on said axis and the toolholder is being extended into and retracted from said die guiding means to move the dies of said set along said axis into and out of engagement with said die guiding means.

2. The improvement set forth in claim 1 as applied to a machine in which said dies of said set are operable to swage a workpiece as it is axially fed along said axis.

3. The improvement set forth in claim 1 as applied to a machine in which said dies of said set are operable to recess a workpiece as it is fixed on said axis.

4. The improvement set forth in claim 1 as applied to a machine in which said die actuating means comprise a plurality of stems, which are equiangularly spaced around said axis and are radially movable to radially move respective ones of said dies of said set toward said axis.

5. The improvement set forth in claim 4 as applied to a machine in which a wedge extends between each of said stems and one of said dies of said set and is movable along said axis to vary the radial spacing of said stem and die.

6. The improvement set forth in claim 5, wherein each of said wedges is retractable from a respective stem and die engaged by said die guiding means in order to release said die for an exchange.

7. The improvement set forth in claim 5, wherein each of said wedges has a small end adapted to extend between a respective stem and die engaged by said die guiding means and is provided at said small end with lateral projections and said die guiding means are formed with an oblique slideway for slidably supporting said lateral projections to restrain said small ends against falling toward said axis as one of said toolholders moves said dies of one of said sets out of and into engagement with said die guiding means.

8. The improvement set forth in claim 1, wherein said front cover is pivoted on a first pivotal axis, which is parallel to said workpiece feeding axis and said die handling member is pivoted on a second pivotal axis, which is parallel to said workpiece feeding axis.

9. The improvement set forth in claim 1, wherein said front cover is displaceable in a direction which is transverse to said axis and said die handling member is displaceable in a direction which is transverse to said axis.

10. The improvement set forth in claim 1, wherein said die handling member is formed with a cam slot and said front cover is provided with a cam follower engaging said cam slot to couple said front cover and said die handling member for moving in unison transversely to said axis.

11. The improvement set forth in claim 1, wherein a plurality of operating levers are pivoted to said die handling member on respective pivotal axes, which are parallel to said workpiece feeding axis, and each of said operating levers is coupled to and is pivotally operable to extend the associated toolholder into and to retract it from said die guiding means when said chamber containing said toolholder is centered on said workpiece feeding axis.

12. The improvement set forth in claim 11, wherein each of said operating levers is coupled to one of said toolholders by a slot in said operating lever and a pin fixed to said toolholder and protruding into said slot.

13. The improvement set forth in claim 11, wherein each of said operating levers has a hook-shaped portion defining a recess and a piston rod for pivotally operating each of said operating levers has a hook-shaped free end portion engaging a operating arm in said recess.

14. The improvement set forth in claim 11, wherein each of said operating levers comprises a first arm which is coupled to said toolholder and a second arm which comprises said hook-shaped portion.

15. The improvement set forth in claim 1, wherein each of said toolholders comprises a toolholder housing and said die gripping means of each of said toolholders comprise a plurality of equiangularly spaced apart rockers, which are pivoted in said housing on respective pivotal axes which are transverse to said workpiece feeding axis, said rockers of each of said toolholders being pivotally movable about said pivotal axes to lock and release respective dies of one of said sets.

16. The improvement set forth in claim 15, wherein each of said toolholder housings is formed in its outside peripheral surface with a plurality of slots, which are equiangularly spaced apart and extend along said workpiece feeding axis, each of said rockers of each of said toolholders is pivoted in said toolholder housing in one of said slots and has an end portion which protrudes from said toolholder housing and is formed with a radially inwardly facing beveled surface and with a radially inwardly directed projection, and each of said dies is formed with a beveled surface for mating engagement with said beveled surface of one of said rockers and is also formed with a recess for receiving said projection of said rocker to lock said die to said rocker.

17. The improvement set forth in claim 16, wherein said rockers are spring-biased to a locking position for locking respective ones of said dies, a camming ring is slidably mounted in each of said toolholder housings for a movement along said axis and is formed in its outside peripheral surface with a plurality of equiangularly spaced apart slots, which extend radially inwardly and axially outwardly with respect to said tool guiding means, each of said rockers comprises a first arm protruding from said toolholder housing toward said die guiding means and a second arm, which is formed with a cam follower extending into one of said slots, and a push rod is associated with each of said chambers and is longitudinally slidably mounted in said die handling member and is operable to engage one of said rockers of the associated toolholder to move said one rocker out of said locking position, and to force said cam follower of said one rocker further into one of said slots to impart to said camming member an axial movement, which owing to the cooperation of the other ones of said slots and the other ones of said cam followers in the same toolholder housing causes also the other rockers of said toolholder to move out of said locking position.

18. The improvement set forth in claim 17, wherein an axially extending backing member is centrally disposed in each of said toolholder housings and has an end portion which is axially slidably mounted in said camming ring and another end portion which is axially slidably mounted in said toolholder housing and protrudes from said toolholder housing toward said die guiding means and is axially engageable with the dies of one of said sets.

19. The improvement set forth in claim 17, wherein each of said push rods has a beveled end face opposite to the associated rocker and piston rod means are provided, which extend at right angles to each of said push rods and have a beveled end face for mating engagement with said beveled end face of each of said push rods and are axially operable to move each of said push rods into engagement with the associated rocker of one of said toolholders when the associated chamber is centered on said workpiece feeding axis.

20. The improvement set forth in claim 19, wherein said beveled end face of each of said push rods is disposed in said die handling member and each of said piston rods is extensible into said die handling member for mating engagement with said beveled end face of each of said push rods and is retractable out of said die handling member to permit said die handling member to move to each of said inner and outer and intermediate positions and is extensible into said die handling member for a mating engagement of said beveled end face of said piston rod with said beveled end face of each of said push rods.

* * * * *